United States Patent [19]

Knecht

[11] 4,387,002

[45] Jun. 7, 1983

[54] ADHESIVE DISCHARGE DEVICE

[75] Inventor: Siegfried H. Knecht, Gevelsberg, Fed. Rep. of Germany

[73] Assignee: Maschinenfabrik Alfred Schmermund GmbH & Co., Fed. Rep. of Germany

[21] Appl. No.: 408,145

[22] Filed: Aug. 16, 1982

Related U.S. Application Data

[63] Continuation of Ser. No. 234,650, Feb. 17, 1981, abandoned.

[30] Foreign Application Priority Data

Mar. 29, 1980 [DE] Fed. Rep. of Germany ..... 3012371

[51] Int. Cl.[3] ..... B65D 47/40; B67D 3/02

[52] U.S. Cl. ..... 156/578; 118/268; 118/302; 118/711; 222/187; 222/402.12; 222/556; 222/562

[58] Field of Search ..... 156/578; 118/203, 241, 118/268, 302, 711; 222/187, 402.1, 402.12, 556, 562

[56] References Cited

U.S. PATENT DOCUMENTS

| | | | |
|---|---|---|---|
| 2,718,870 | 9/1955 | McFarland | 118/203 |
| 2,737,416 | 3/1956 | Behr et al. | 222/402.12 |
| 2,806,443 | 9/1957 | Horn et al. | 118/241 |
| 3,876,144 | 4/1975 | Madden et al. | 118/302 |
| 3,964,835 | 6/1976 | Eigenmann | 156/578 |

*Primary Examiner*—Michael G. Wityshyn

*Attorney, Agent, or Firm*—Williamson, Bains, Moore & Hansen

[57] ABSTRACT

An adhesive discharge device for use with adhesive which sets by the evaporation of a solvent. The device incorporates a valve-controlled discharge nozzle for intermittent discharge of adhesive on a cycle basis. Drying of adhesive around the nozzle opening when the valve is closed and the discharge of adhesive is interrupted is prevented by a movable closure cap containing a solvent vaporizer. The closure cap is movable into a position enclosing and sealing the nozzle opening, and the vaporization of solvent inside the closure cap around the nozzle opening prevents the drying and encrustation of adhesive.

7 Claims, 2 Drawing Figures

ADHESIVE DISCHARGE DEVICE

This is a continuation of application Ser. No. 234,650, filed Feb. 17, 1981 now abandoned.

The invention relates to an adhesive discharge device, by means of which, for example, within the confines of a packaging machine adhesive is discharged on to packaging material to be cemented. One problem of such devices is that the adhesive is discharged on a cycle basis, and the exit of adhesive must be interrupted during the discharge intervals. For this purpose, shut-off valves of various types are known (German patent application Nos. DE-OS 27 09 935, DE-OS 15 77 776). Adhesive which remains in the channels between the valve or shut-off gate and the nozzle opening tends to form incrustation. In German application No. DE-OS 27 09 935, it is therefore proposed to suck back the adhesive from this part of the nozzle on shutting-off the device. This is suitable if the adhesive is of the hot-melting type. However, if adhesives are used which set by means of solvent evaporation, such a device is naturally hardly suitable for solving the incrustation problem.

The object of the invention is to provide an adhesive discharge device which cannot become unusable due to drying of the adhesive in the region of the nozzle opening.

This object is attained according to the invention by providing a closure cap which is mounted to be movable into a position in sealing engagement with the body of the nozzle around the nozzle outlet opening and mounting a solvent vaporizer inside of the closure cap. When the closure cap is moved into the aforesaid sealing position it defines with the nozzle body an enclosed solvent vaporization space around the nozzle outlet opening into which solvent evaporates from the solvent vaporizer carried by the closure cap. This prevents the drying and encrustation of adhesive around the nozzle outlet opening. The device is particularly suitable for water-soluble adhesive, as this solvent is available practically everywhere at very low cost.

Figure 1:
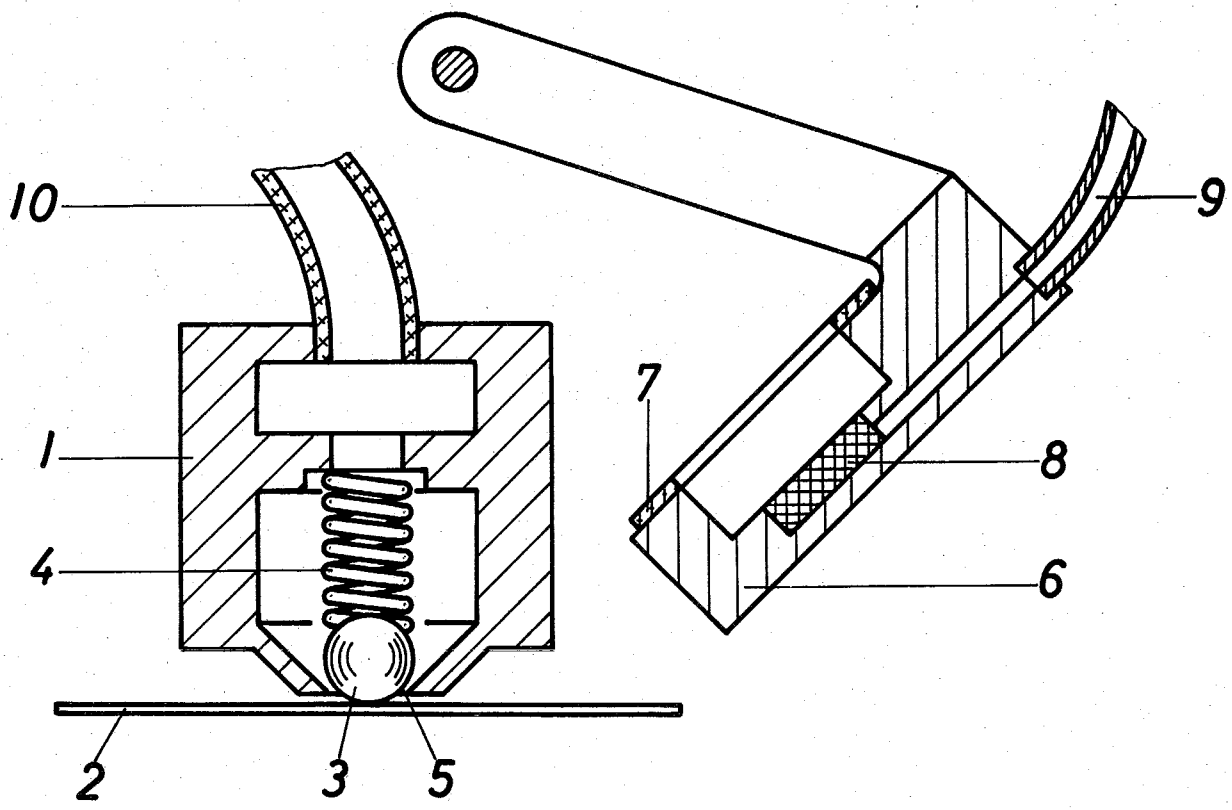
Figure 2:
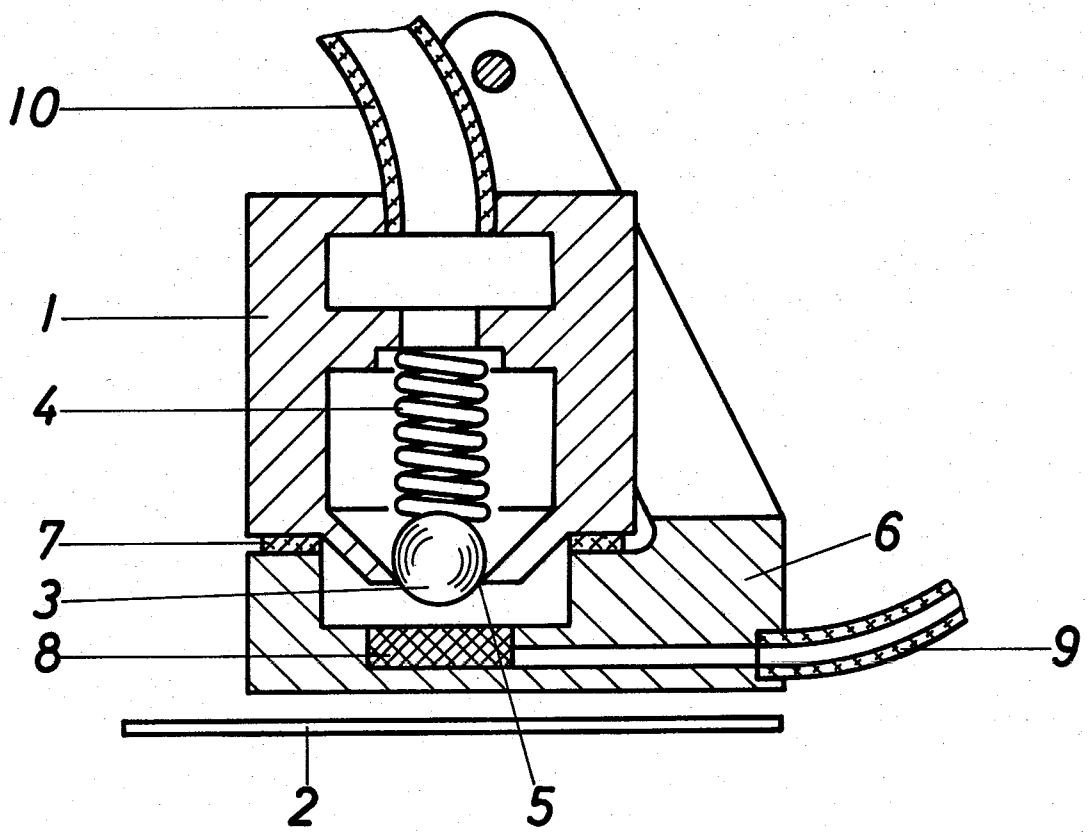

A preferred embodiment of the invention is illustrated in the accompanying drawings, in which:

FIG. 1 is a substantially diagrammatic longitudinal section through the device during the discharge stage, and FIG. 2 shows the device of similar form as in FIG. 1, but during the discharge interval.

As shown in FIG. 1, the adhesive nozzle 1 is pressed, for example by means of a pneumatic cylinder (not shown), on to a material track 2 to be glued. By this means, the ball 3 is displaced against the force of the spring 4, and uncovers an annular gap 5 from which the adhesive leaves. The adhesive is fed to the nozzle 1 through the feed line 10. If the nozzle 1 is lifted from the material track 2, as shown in FIG. 2, the annular gap 5 becomes closed by the ball 3.

When an interval occurs between two discharge operations, the closure cap 6 is swivelled into the position shown in FIG. 2, and the adhesive nozzle 1 is pressed against the gasket 7, so that the nozzle mouth together with the ball 3 becomes sealed against the outside air. Inside the closure cap 6 there is mounted a felt wick 8, which can be connected by means of the feed line 9 to a solvent reservoir, not shown, and is impregnated therewith. The air inside the closure cap 6 thus becomes saturated with solvent, and consequently prevents drying of the adhesive.

The closure cap can be moved into the position shown in FIG. 2 either at each discharge interval, or only during longer intervals, such as when a shut-down of the complete plant in which the device is used becomes necessary.

I claim:

1. In an adhesive discharge device comprising a part of packaging apparatus for the application to packaging material of adhesive of the type which sets by the evaporation of a solvent, and wherein the device is comprised of a nozzle body having a nozzle outlet opening for adhesive controlled by a valve mechanism actuable to an open position by pressure contact with packaging material, the improvement comprising:

a closure cap pivotally mounted adjacent to said nozzle body and swingably movable between a remote, open position and a position in sealing engagement with said nozzle body around said nozzle outlet opening to define with said body an enclosed solvent vaporization space around said outlet opening; and a solvent vaporizer contained inside of and carried by said closure cap for dispensing solvent in said enclosed space, whereby the vaporization of solvent within said enclosed space with said cap in said sealing position prevents the drying of adhesive around said nozzle outlet opening.

2. An adhesive discharge device as defined in claim 1 wherein:

said solvent vaporizer comprises a wick which projects into said enclosed space and is fed from a solvent reservoir.

3. The use of the device as claimed in claim 1 or 2 for water-soluble adhesive.

4. An adhesive discharge device as defined in claim 1, and further including:

passage means within said closure cap communicating said solvent vaporizer with a remote source of solvent.

5. An adhesive discharge device as defined in claim 1 wherein:

said valve mechanism comprises a ball valve element normally urged by spring means against said nozzle outlet opening to a closed position wherein said valve element projects externally out of said nozzle opening for pressure contact with packaging material to move said valve against the pressure of said spring means to an open position.

6. An adhesive discharge device as defined in claim 1, and further including:

mechanical means for moving said nozzle body against packaging material to force said valve mechanism open or against said closure cap to hold said nozzle body in sealing engagement with said closure cap.

7. An adhesive discharge device as defined in claim 1, and further including:

conduit means connecting said nozzle body with a remote source of adhesive.

* * * * *